United States Patent [19]

Kaye

[11] Patent Number: 4,763,374

[45] Date of Patent: Aug. 16, 1988

[54] POWERED DRAIN CLEANER

[75] Inventor: Paul S. Kaye, Racine, Wis.

[73] Assignee: Lewisan Products, Inc., Racine, Wis.

[21] Appl. No.: 130,206

[22] Filed: Dec. 7, 1987

[51] Int. Cl.[4] ..... B08B 9/02

[52] U.S. Cl. ..... 15/104.33

[58] Field of Search ..... 15/104.31, 104.33; 254/134.3 FT; 242/54

[56] References Cited

U.S. PATENT DOCUMENTS

| | | | |
|---|---|---|---|
| 2,223,005 | 11/1940 | Kerber | 15/104.33 |
| 2,297,755 | 10/1942 | Faust | 15/104.33 |
| 2,468,490 | 4/1949 | Joseph | 15/104.33 |
| 4,340,988 | 7/1982 | Shames | 15/104.33 |
| 4,364,139 | 12/1982 | Babb et al. | 15/104.33 |

*Primary Examiner*—Edward L. Roberts

*Attorney, Agent, or Firm*—Peter N. Jansson, Ltd.

[57] ABSTRACT

A powered drain-cleaning implement of the type with a rotatable snake extendable for drain insertion. The device has a housing with a rear portion over the motor and a front portion terminating in a collar, a snake container rotatably supported in the front portion and having a forward tubular portion extending through the collar and ending in a distal opening where the snake is adjustably secured, a ring gear on the back of the container, and a pinion gear on the motor engaging the ring gear for high-torque rotation of the snake. The housing preferably substantially covers the motor, gears and container. Its rear portion preferably has a handle and associated trigger for easy holding and operation.

20 Claims, 3 Drawing Sheets

POWERED DRAIN CLEANER

FIELD OF THE INVENTION

This invention is related generally to implements for cleaning drains and, more particularly, to powered drain-cleaning implements of the type having rotatable snakes extendable for insertion into drains.

BACKGROUND OF THE INVENTION

Drain-cleaning implements of the type having snakes progressively insertable into clogged drains and the like have been well-known and widely used for many years. As commonly understood and as used herein, "snake" means a lengthy and tightly-wound coil of rigid wire or the like.

Many variations of such devices have been used and many improvements developed over the years. Many such implements have electric motors or other power sources to rotate a snake around the axis defined along its length. Such motors are in some cases supported in a base unit and in other cases may themselves be part of a portable implement. This invention relates to the latter type of drain-cleaning implement.

Numerous disadvantages and problems are present in devices of the prior art.

Many of such prior devices are very complex in structure and very unwieldy in operation. They are difficult to hold and manipulate during drain-cleaning operations, often requiring two hands and requiring complex manipulations for progressive insertion of the snakes into the drains. The drive mechanisms of some of such prior devices are complex, structurally unsound, and/or prone to breakdown.

The drive mechanisms of such prior devices often provide insufficient torque during startup, which can lead to stalling and the need to prematurely withdraw the snake from the drain to some extent in order to allow startups. In some devices of the prior art, power-driven parts are unshielded, thus causing a risk of injury during use and imposing operation complications to avoid contact with moving parts.

In short, there has been a long-standing need for an improved portable powered drain-cleaning implement.

OBJECTS OF THE INVENTION

It is an object of this invention to provide an improved portable powered drain-cleaning implement overcoming some of the problems and shortcomings of the prior art, including those mentioned above.

Another object of this invention is to provide an improved powered drain cleaning implement which is simple in structure.

Another object of this invention is to provide an improved powered drain-cleaning implement which is easily manipulated during operation.

Another object of this invention is to provide an improved powered drain-cleaning implement may easily be held and manipulated with one hand, even during progressive insertion of the snakes into a drain.

Another object of this invention is to provide an improved powered drain-cleaning implement which is less prone to breakdown than implements of the prior art.

Another object of this invention is to provide an improved powered drain-cleaning implement providing good torque during startup and while encountering substantial obstacles, thus avoiding the need to prematurely withdraw the snake from the drain to allow restarts.

Another object of this invention is to provide an improved powered drain-cleaning implement in which substantially all moving parts are shielded, thus reducing the risk of injury during use and making operation easier.

These and other important objects will be apparent from the descriptions of this invention which follow.

SUMMARY OF THE INVENTION

This invention is an improved drain-cleaning implement of the type with a snake which is rotatable about its axis and extendable for drain insertion and a motor to rotate the snake. The invention overcomes certain problems and shortcomings of the prior art, including those mentioned above, and provides important advantages.

The drain-cleaning implement of this invention includes: a housing with a rear portion to which the motor is secured and a front portion terminating forwardly in a collar; a snake container rotatably supported within the housing and having a wide back portion which holds the snake in a coil and a forwardly-extending tubular portion which extends through the collar and terminates in a distal opening through which the snake exits the container; means adjacent to the distal end to clamp the snake in selected axial positions with respect to the tubular member; a ring gear secured to the back portion of the container; and a pinion gear secured to the motor and engaging the ring gear for high-torque rotation of the container and snake.

The housing preferably substantially cover the motor, the gears, and the container except for the distal opening portion thereof, and thus substantially shields all moving parts. This makes use of the implement safe and easy.

In certain preferred embodiments, the front portion of the housing has a substantially conical annular inside wall and the back portion of the container has a generally matching substantially conical annular outside wall adjacent to the inside wall. Bearing projections extend from at least one of the inside and outside walls and engage the other of the inside and outside walls. Such bearings facilitate the rotation of the container within the housing, minimizing the rotational friction.

In certain preferred embodiments, including some as just described, the back portion of the container has a back wall to which the ring gear is secured and the rear portion of the housing has a front wall adjacent to the back wall. The pinion gear extends in front of such front wall, with the motor mounted in place in back of such wall. Means extending between the back and front walls rotatably support the container in fixed concentric position with respect to the front wall of the rear portion of the housing.

Such rotatable support means preferably include a shaft which is secured to the back wall of the container and extends rearwardly from it and a receptacle on the rear portion of the housing which rotatably receives the shaft. Some preferred embodiments also include bearing projections which extend from at least one of the back and front walls to engage the other of the back and front walls, in order to facilitate rotation of the container and minimize rotational friction.

In highly preferred embodiments, the drain-cleaning implement of this invention includes as its motor an electric motor of the permanent magnet type. Using such a motor allows immediate torque when the motor is started, which facilitates stopping and starting of the implement during drain-cleaning operations.

In certain highly preferred embodiments of this invention, the rear portion of the housing has a handle on it, which is most preferably integrally formed with the housing, with a trigger switch mounted adjacent to the handle. With such a handle, the drain-cleaning implement of this invention may be readily and easily held and operated with one hand.

DETAILED DESCRIPTIONS OF PREFERRED EMBODIMENTS

Figure 1:
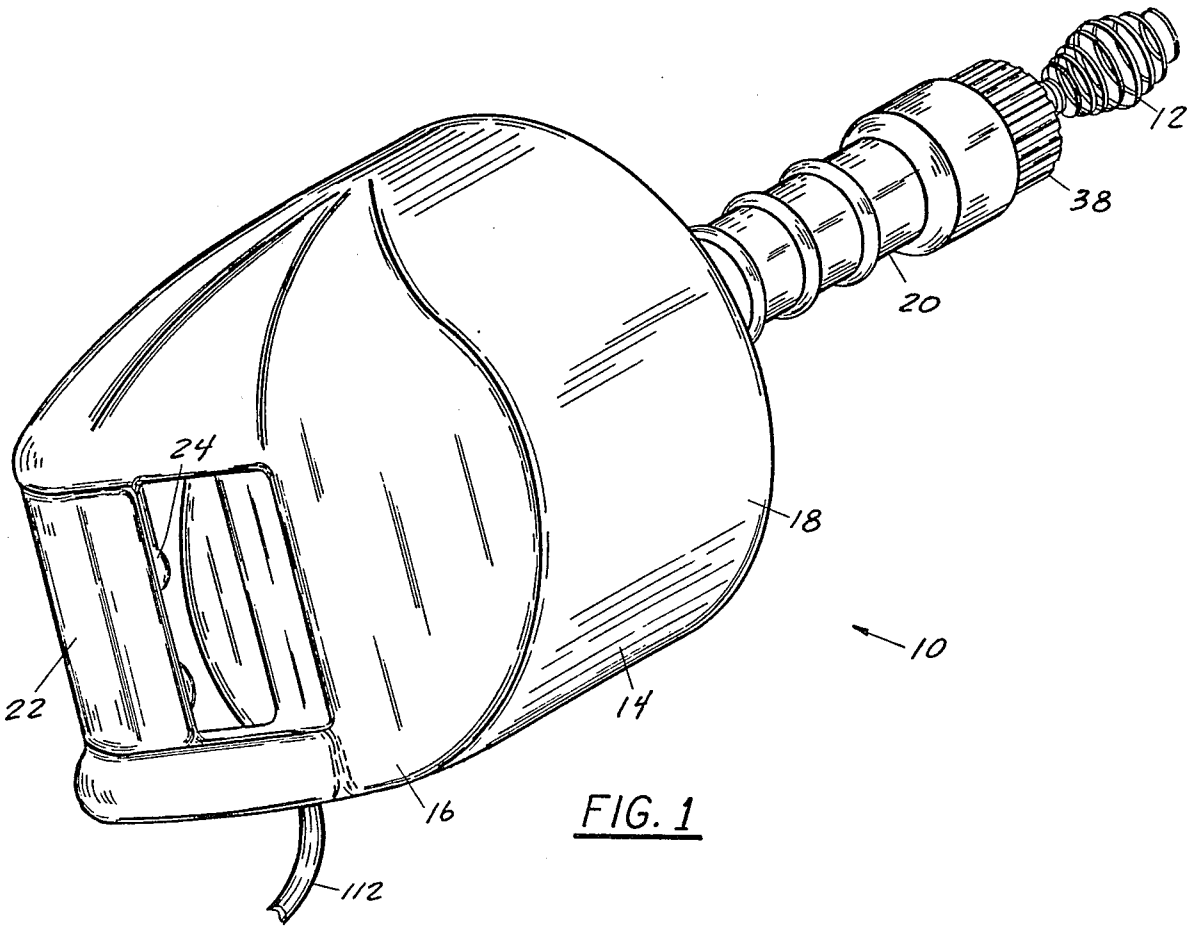
FIG. 1 is a perspective view of an improved drain-cleaning implement in accordance with this invention.

The figures illustrate a drain-cleaning implement 10 in accordance with theis invention. Drain-cleaning implement 10 is of the type including a snake 12 which is rotatable about its axis and extendable for insertion into a drain, a gripper which is adjustably secured to the snake and rotatable with the snake, and a means to rotate the snake for drain cleaning purposes.

Drain cleaning implement 10 includes a housing 14 having a rear portion 16 and a front portion 18. Housing 14 substantially covers all moving parts of drain-cleaning implement 10 except for portions immediately at the forward end thereof from which the snake extends. Housing front portion 18 terminates forwardly in a tubular collar 20.

Housing rear portion 16 includes handle 22 which is integrally formed therewith. A trigger switch 24 is mounted to rear portion 16 of housing 14 in a position immediately adjacent to handle 22, allowing drain-cleaning implement 10 to be readily and easily held and operated with one hand.

Container 26 is rotatably supported within front portion 18 of housing 14. Container 26 has a wide back portion 28 which contains most of snake 12 and a forwardly-extending tubular portion 30 which extends concentrically through collar 20 and terminates in distal opening 32 through which snake 12 and exits container 26.

Snake 12, which is a tightly wound coil of rigid metal wire, as is well known in the drain cleaning art, has a major portion 34 which, as already noted, is wound in loops confined within back portion 28 of container 26. Snake 12 also includes an unwound portion which extends through tubular portion 30 and out distal opening 32 to terminate in an enlarged drain-insertable distal end 36, as is well known in the art.

The forward end portion of tubular portion 30 has an externally threaded male part on which a finger nut 38 which is adjustably screwed. A collet member 40 is secured at the distal end of tubular portion 30. Collet member 40 has splits in it and an annular tapered outward surface 42 which is engaged by an annular tapered inward surface 44 on finger nut 38. Snake 12 passes through collet member 40 and may be clamped or released by collet member 40 depending upon the position of finger nut 38. This structure provides means adjacent to the forward end portion of tubular portion 30 to clamp snake 12 to tubular portion 30 of container 26, in selected axial positions depending on the length of snake 12 which the operator has pulled from container 26.

Wide back portion 28 of container 26 has a back wall 46 which is secured to container 26 by means of screws 47, or other suitable attachment means. Back wall 46 includes an radially inwardly facing annular surface 48 against which an internally-toothed ring gear 50 is affixed. The attachment of ring gear 50 to back wall 46 is rigid such that container 26 and ring gear 50 rotate as one. Also secured to back wall 46 and extending rearwardly from it in a central position is a shaft 52.

Rear portion 14 of housing 16 has a front wall 54 which is affixed to and parallel to back wall 46. Front wall 54 of housing rear portion 16 has an off-center opening 56. An electric motor 58 of the permanent magnet type is held on place within rear portion 16 of housing 14 by housing features which secure it non-rotatably in fixed off-center position with respect t housing 14 with its motor shaft 60 and a pinion gear 62 mounted thereon extending through opening 56.

Pinion gear 62 is in a position in front of front wall 54. Pinion gear 62, which turns with motor 58, engages gear 50 and imparts a high-torque rotation to ring gear 50 and thus to container 26 and snake 12.

Front wall 54 supports a shaft receptacle 64 in housing rear portion 16. Shaft receptacle 64 rotatably receives shaft 52 and provides means between back wall 46 and front wall 54 for rotatable support of container 26 in fixed concentric position with respect to front wall 54 of housing rear portion 16.

A compression spring 66 extends between shaft 52 and a spring mount 68, which is secured to, preferably integrally formed with, housing rear portion 16. Compression spring 66 biases shaft 60 and container 26 to a forward position. Container 26 is axially movable to a slight extent within housing 14, with compression spring 66 urging container 26 to its forwardmost position.

Housing front portion 18 has a conical annular inside wall 70. Wide back portion 28 of container 26 has a conical annular outside wall 72 which is adjacent to conical inside wall 70. Annular projections 74 extend forwardly from conical outside wall 72 to engage conical inside wall 70 when container 26 is in its forwardmost position. In such position of container 26, annular projections 74 serve as bearings between container 26 and housing 143. Indeed, such contact defines the forwardmost position of container 26.

Back wall 46 of container 26 has an annular projection 76 extending rearwardly in position to engage front wall 54 of housing rear portion 16 when container 26 is in its rearwardmost position. In such position of container 26, annular projection 76 serves as a rotational bearing of container 26 on housing 14.

Figure 2:
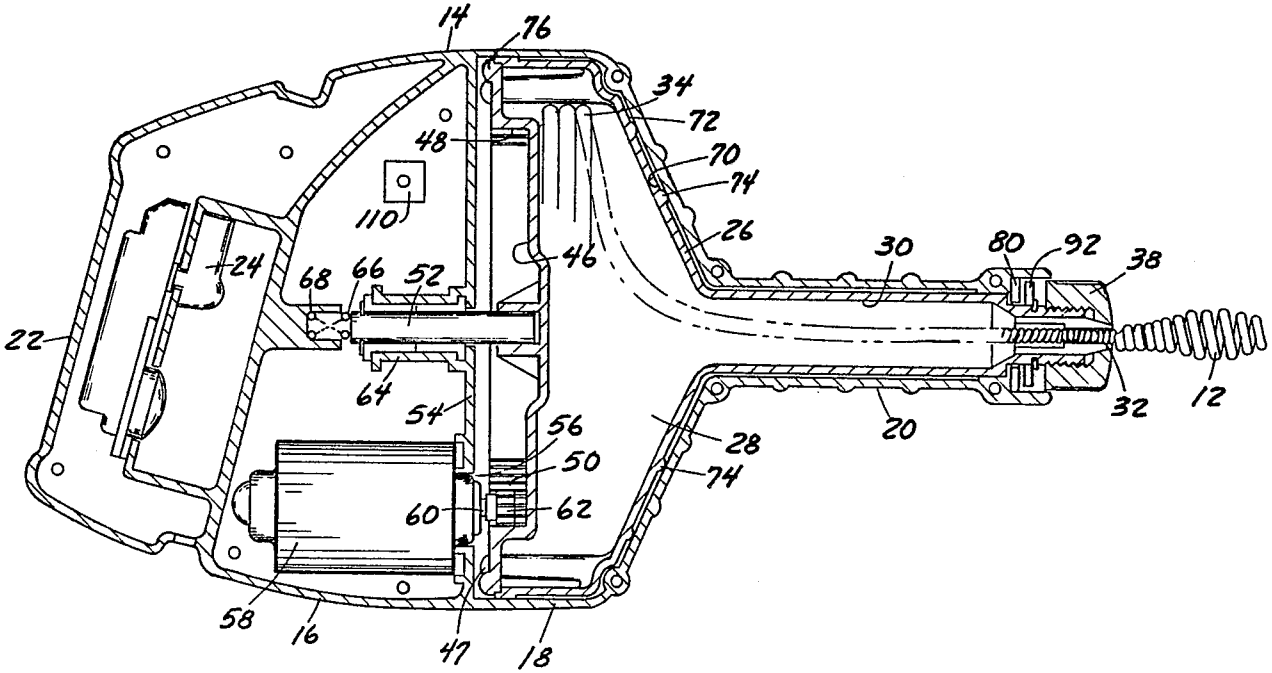
FIG. 2 is a side sectional view.

Electric motor 58 is a 12-volt DC motor of the permanent-magnet type. Motor 58 is powered by 110-volt AC received by means of cable 112 and taken through a bridge rectifier 110, shown in FIG. 2. Electric wiring (not shown) would be apparent to those skilled in the art who are familiar with this invention.

Drain-cleaning implement 10 includes means to impart vibratory motion to snake 12 at a frequency greater than the rate of rotation of container 26 and snake 12. Such vibration allows snake 12 to pass traps and other obstacles in a drain with ease.

Collar 20 includes an axially-facing annular ledge 78. A first vibratory member 80 is non-rotatably secured against annular ledge 78. First vibratory member 80 includes eight flat surface 82 shaped to be engaged by complementary characteristics on collar 20, to hold first vibratory member 80 non-rotatably with respect to collar 20. Screws 86 also serve to secure first vibratory member 80 non-rotatably against collar 20.

The distal end of tubular portion 30 of container 26 has a hexagonal portion 88 close to the aforementioned threaded portion on which finger nut 38 is attached. A second vibratory member 92 has a hexagonal opening 94 sized to engage hexagonal portion 88 such that second vibratory member 92 is non-rotatably secured to tubular portion 30.

Figures 3, 4:
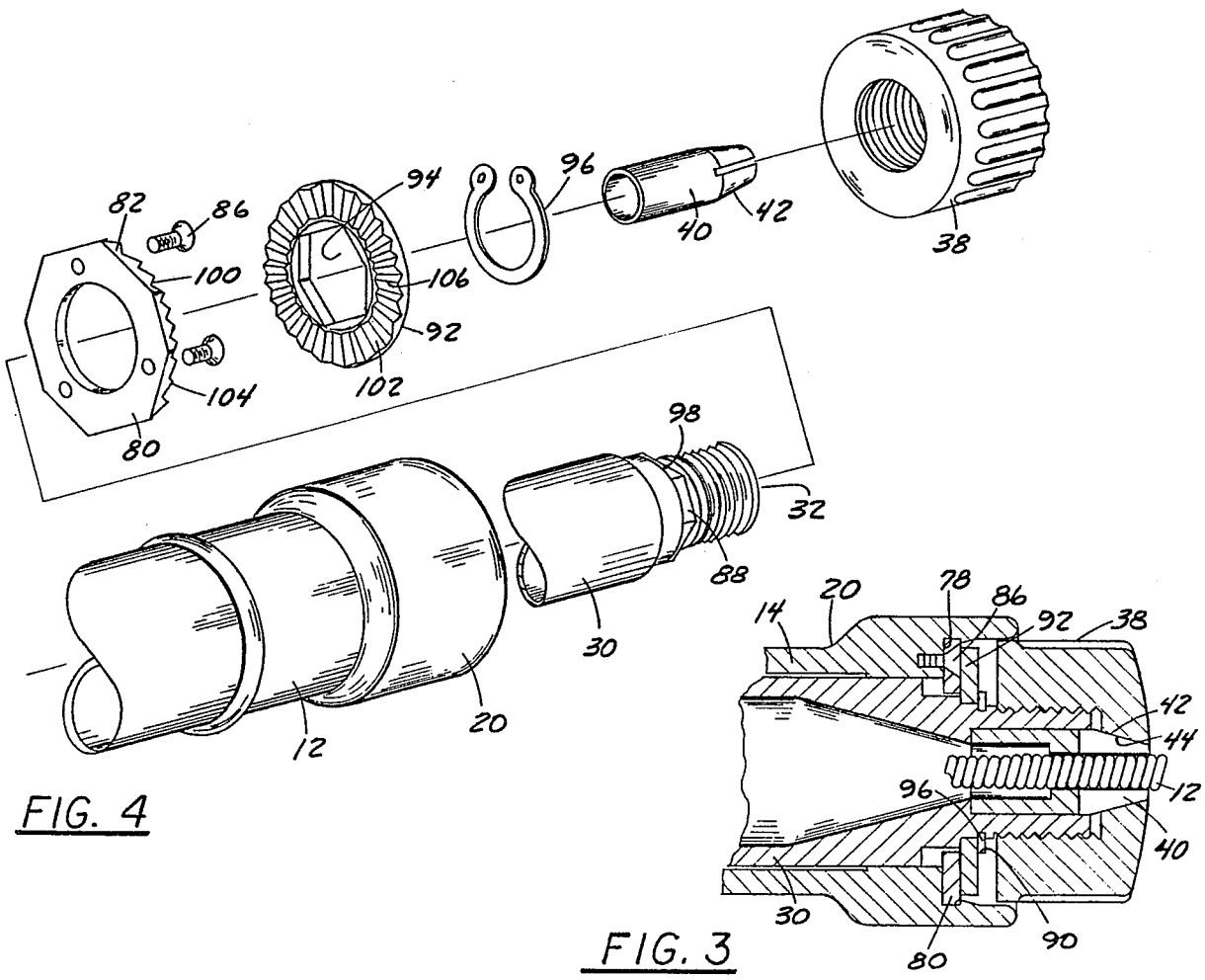
FIG. 3 is a magnified fragmentary view of FIG. 2, illustrating the portion of the implement from which the snake extends.
FIG. 4 is an exploded fragmentary perspective view of FIG. 3.

Between hexagonal portion 88 of container tubular portion 30 and the threaded portion is a narrow groove 90. Beyond hexagonal portion 88 is a axially outwardly facing ledge 98. Second vibratory member 92 has an axial dimension such that it is held in fixed axial position with respect to container tubular portion 30 on hexagonal portion 88, with a snap 96 in groove 90 holding second vibratory member 92 against ledge 98, as shown in FIGS. 3 and 4.

Thus, second vibratory member 92 moves axially only with the movement of container tubular portion 30 and rotates only with the rotation of container tubular portion 30. Stated differently, second vibratory member 92 moves axially and rotates with snake 12 and the gripper elements which engage snake 12.

First vibratory member 80 has a first annular vibration-imparting surface 100 which faces in an outward axial direction. Second vibratory member 92 has a second annular vibration-imparting surface 102 which faces in an inward axial direction, facing first vibration-imparting surface 100.

First and second vibratory members 80 and 92, and their respective vibration-imparting surfaces 100 and 102, are relatively movable with the relative movement of container 26 and collar 20. Such movement is between positions of engagement and non-engagement of the vibration-imparting surfaces 100 and 102.

First and second vibration-imparting surfaces 100 and 102 have radially-spaced axially-extending teeth 104 and 106, respectively. Teeth 104 and 106 are angled so that surfaces 100 and 102 can rotate while in contact.

Teeth 106 of second surface 102 are alternately engagable on and between teeth 104 of first surface 100 as container 26 and its tubular portion 30 rotate with respect to collar 20, when axial pressure has been applied to snake 12 to the extent that surfaces 100 and 102 are engaged. This interaction of teeth 104 and 106 imparts an axial vibration to container 26 and snake 12. Such vibration occurs at a rate which is a multiple of the rotation rate of container 26 and snake 12.

Vibration only occurs when axial pressure has been applied on snake 12, for example, as it meets obstacles within the drain to be unclogged. This axial pressure causes container 26 to overcome the biasing force of compression spring 66 such that surfaces 100 and 102 are engaged. When such axial force on snake 12 is relaxed, compression spring 66 will disengagement of surfaces 100 and 102, such that rotation of container 26 and snake 12 can continue without vibration. Axial force on snake 12 is supplied by the operator by grasping handle 22 and pushing snake 12 into the drain against an obstacle.

First and second vibratory members 80 and 92 are preferably made of hardened carbon-chromium steel alloys. However, a wise variety of other metals and other hardened materials can be used. Housing 14 is preferably formed from a pair of substantially mirror-image plastic shells which may be secured together by screws or other means well known in the plastics art. Ring gear 50 and pinion gear are preferably nylon gears, but a variety of other materials may be used.

While the principles of this invention have been described in connection with specific embodiments, it should be understood clearly that these descriptions are made only by way of example and are not intended to limit the scope of the invention.

I claim:

1. In a drain-cleaning implement of the type with a snake rotatable about its axis and extendable for drain insertion and a motor to rotate the snake, the improvement comprising:

a housing having a rear portion to which the motor is secured and a front portion terminating forwardly in a collar;

a snake container rotatably supported within the housing, the container having a wide back portion and a forwardly-extending tubular portion which extends through the collar and terminates in a distal opening through which the snake exits the container;

means adjacent to the distal opening to clamp the snake in selected axial positions with respect to the tubular member;

a ring gear secured to the back portion of the container; and a pinion gear secured to the motor and engaging the ring gear for high-torque rotation of the container and snake.

2. The drain-cleaning implement of claim 1 wherein the housing substantially covers the motor, the gears, and the container except for the distal opening portion thereof, thus substantially shielding all moving parts.

3. The drain-cleaning implement of claim 1 wherein:

the housing front portion has a substantially conical annular inside wall;

the container back portion has a substantially conical annular outside wall adjacent to the inside wall; and bearing projections from at least one of the inside and outside walls engaging the other of the inside and outside walls.

4. The drain-cleaning implement of claim 1 wherein:

the back portion of the container has a back wall, the ring gear secured to the back wall; and the rear portion of the housing has a front wall adjacent to the back wall, the pinion gear extending in front of the front wall; and means extending between the back and front walls to rotatably support the container in fixed concentric position with respect to the front wall of the rear portion of the housing.

5. The drain-cleaning implement of claim 4 wherein the rotatable support means comprises:

a shaft secured to the back wall of the container and extending rearwardly therefrom; and a receptacle on the rear portion of the housing rotatably receiving the shaft.

6. The drain-cleaning implement of claim 4 further comprising bearing projections from at least one of the back and front walls engaging the other of the back and front walls.

7. The drain-cleaning implement of claim 6 wherein the rotatable support means comprises:

a shaft secured to the back wall of the container and extending rearwardly therefrom; and a receptacle on the rear portion of the housing rotatably receiving the shaft.

8. The drain-cleaning implement of claim 7 wherein:

the housing front portion has a substantially conical annular inside wall;

the container back portion has a substantially conical annular outside wall adjacent to the inside wall; and bearing projections from at least one of the inside and outside walls engaging the other of the inside and outside walls.

9. The drain-cleaning implement of claim 8 wherein the housing substantially covers the motor, the gears, and the container except for the distal opening portion thereof, thus substantially shielding all moving parts.

10. The drain-cleaning implement of claim 1 wherein the motor is a permanent magnet motor.

11. The drain-cleaning implement of claim 1 wherein the rear portion of the housing has a handle with a trigger switch mounted adjacent thereto, whereby the implement may be readily and easily held and operated with one hand.

12. The drain-cleaning implement of claim 11 wherein the housing substantially covers the motor, the gears, and the container except for the distal opening portion thereof, thus substantially shielding all moving parts.

13. The drain-cleaning implement of claim 11 wherein:

the housing front portion has a substantially conical annular inside wall;

the container back portion has a substantially conical annular outside wall adjacent to the inside wall; and bearing projections from at least one of the inside and outside walls engaging the other of the inside and outside walls.

14. The drain-cleaning implement of claim 11 wherein:

the back portion of the container has a back wall, the ring gear secured to the back wall; and the rear portion of the housing has a front wall adjacent to the back wall, the pinion gear extending in front of the front wall; and means extending between the back and front walls to rotatably support the container in fixed concentric position with respect to the front wall of the rear portion of the housing.

15. The drain-cleaning implement of claim 14 wherein the rotatable support means comprises:

a shaft secured to the back wall of the container and extending rearwardly therefrom; and a receptacle on the rear portion of the housing rotatably receiving the shaft.

16. The drain-cleaning implement of claim 14 further comprising bearing projections from at least one of the back and front walls engaging the other of the back and front walls.

17. The drain-cleaning implement of claim 16 wherein the rotatable support means comprises:

a shaft secured to the back wall of the container and extending rearwardly therefrom; and a receptacle on the rear portion of the housing rotatably receiving the shaft.

18. The drain-cleaning implement of claim 17 wherein:

the housing front portion has a substantially conical annular inside wall;

the container back portion has a substantially conical annular outside wall adjacent to the inside wall; and bearing projections from at least one of the inside and outside walls engaging the other of the inside and outside walls.

19. The drain-cleaning implement of claim 18 wherein the housing substantially covers the motor, the gears, and the container except for the distal opening portion thereof, thus substantially shielding all moving parts.

20. The drain-cleaning implement of claim 11 wherein the motor is a permanent magnet motor.

* * * * *

UNITED STATES PATENT AND TRADEMARK OFFICE

CERTIFICATE OF CORRECTION

PATENT NO. : 4,763,374

DATED : August 16, 1988

INVENTOR(S) : Paul S. Kaye

It is certified that error appears in the above-identified patent and that said Letters Patent is hereby corrected as shown below:

In column 1, line 58, after "implement" insert --which--.

In column 2, line 33, change "cover" to --covers--.

In column 3, line 25, change "theis" to --this--.

In column 3, line 49, delete "and".

In column 3, line 61, delete "which".

In column 4, line 9, change "an" to --a--.

In column 4, line 19, change "on" to --in--.

In column 4, line 21, at the end of the line, change "t" to --to--.

In column 4, line 37, change "60" to --52--.

In column 4, line 50, change "143" to --14--.

In column 5, line 18, change "is a" to --is an--.

In column 5, line 63, after "will" insert --cause--.

UNITED STATES PATENT AND TRADEMARK OFFICE

CERTIFICATE OF CORRECTION

PATENT NO. : 4,763,374

DATED : August 16, 1988

INVENTOR(S) : Paul S. Kaye

It is certified that error appears in the above-identified patent and that said Letters Patent is hereby corrected as shown below:

In column 6, line 3, change "wise" to -- wide --.

Signed and Sealed this

Fourth Day of July, 1989

*Attest:*

DONALD J. QUIGG

*Attesting Officer*

*Commissioner of Patents and Trademarks*